United States Patent [19]

Tippetts et al.

[11] 4,021,146

[45] May 3, 1977

[54] FLUIDIC FLOW CONTROL DEVICES AND PUMPING SYSTEMS

[75] Inventors: John Russell Tippetts, Sheffield; Joshua Swithenbank, Hathersage, both of England

[73] Assignee: United Kingdom Atomic Energy Authority, Great Britain

[22] Filed: Oct. 30, 1974

[21] Appl. No.: 519,229

[30] Foreign Application Priority Data

Nov. 2, 1973 United Kingdom ..... 50915/73

[52] U.S. Cl. ..... 417/76; 137/822

[51] Int. Cl.[2] ..... F04F 5/10

[58] Field of Search ..... 417/86, 87, 122, 125, 417/76

[56] References Cited

UNITED STATES PATENTS

| | | | |
|---|---|---|---|
| 1,377,871 | 5/1921 | Bowen | 417/125 |
| 1,845,675 | 2/1932 | Martin | 417/87 |
| 2,872,877 | 2/1959 | Brewer | 417/76 |
| 2,879,144 | 3/1959 | Thornton | 417/76 |

*Primary Examiner*—William R. Cline

*Attorney, Agent, or Firm*—Lowe, King, Price & Markva

[57] ABSTRACT

A fluidic flow control device comprising at least two generally aligned members having tapering bores therethrough, the members being so arranged as to constitute a convergence followed by a gradual divergence, separated by a gap, the gap communicating with an inlet/outlet or feed port. A cage connects the adjacent ends of the members and forms said port. A system for pumping may incorporate the device between a cylinder charged with pressure gas and an out-feed pipe. In operation, fluid is alternatively drawn in through the gap and into the cylinder and then pumped out by the gas across the gap and into and through the out-feed pipe. A level detector in the cylinder controls the oscillation of the system and an accumulator may be provided to smooth the outflow. Substantially continuous flow may be provided by coupling two systems to a common out-feed pipe. A pumped flow circuit useful for heat transfer utilizes two alternately operating devices out-feeding to a single diffuser section with connected feedback passages resupplying the devices in turn.

6 Claims, 12 Drawing Figures

FLUIDIC FLOW CONTROL DEVICES AND PUMPING SYSTEMS

This invention relates to fluidic flow control devices, and more particularly, a system for pumping utilizing such devices.

In many industrial flow control systems the fluid presents a harsh environment for the valves and their associated control mechanisms. In such systems fluidic flow control techniques are worth considering. Fluidic flow control is, to some extent, distinct from the better known applications of fluidic logic.

In logic systems information alone is processed but in flow control systems the fluid must follow a definite path without any leakage and, of course, the circuit must operate in a logical fashion. For this reason special purpose fluidic flow control devices have had to be developed and only recently have efficient devices become available. These developments are giving increasing scope for the advantageous application of fluidics to flow control systems.

A widely used system which could benefit by the use of fluidics is that required for the operation of regenerative heat exchangers. In conventional regenerative heat exchanger systems moving-part valves are required to divert large volume flows of very hot, and sometimes dust-laden gas. The valves function in arduous conditions and maintaining reliable operation is a major problem. Reverse flow divertors capable of effecting such operations have been discussed, e.g., in Process Engineering, June 1972, in an article entitled "Improved Reliability Results from Fluidic Flow Control" by J. R. Tippetts.

According to the present invention, a system is provided wherein a fluidic flow control device comprises at least two generally aligned members having tapering bores therethrough, the members being so arranged as to constitute a convergence followed by a gradual divergence, separated by a gap, the gap communicating with an inlet/outlet port or feed. For simplicity, the above device will hereinafter be referred to as a "rectifier-type reverse flow divertor" or "RFD".

Thus, in any system involving the rectification of alternating fluid flow, and when two members (diffusers) are provided in generally co-axial relationship, and with flow in the "forward" state, fluid flows into one (inlet) diffuser which in this state acts as a nozzle, and travels as a jet across the gap and into the second (outlet) diffuser where the velocity of the fluid is reduced and pressure recovered. With the device functioning correctly, no flow exists in the inlet/outlet port. Ideally, as much pressure as possible should be recovered in the "outlet" diffuser, while the pressure in the inlet/outlet port is maintained low. In the reverse condition (i.e. fluid flowing in the opposite direction), fluid is admitted through the port to the gap from where it flows along what was initially the "inlet" diffuser. In this "reversed" state it is important that the least possible resistance is imposed on the flow and that all the pressure drops between the inlet port and the beginning (the larger end) of the "inlet diffuser" and between the inlet/outlet port and the (larger) end of the "outlet diffuser" should be small relative to those in the "forward" state.

The main purpose of the RFD is to operate efficiently in at least two flow states which can be defined as shown in the following table:

| State | $q_a$ | $q_b$ | $q_c$ | $e_a$ | $e_b$ |
|---|---|---|---|---|---|
| Forward | 1 | 1 | 0 | 1 | A |
| Reverse | −1 | 0 | 1 | −B | −C |

where $q_a$ is the flow entering the larger end of the inlet diffuser, $q_b$ is the flow emerging from the larger end of the outlet diffuser, $q_c$ is the flow entering the inlet/outlet port, $e_a$ and $e_b$ are pressure differences defined by $$e_a = p_a - p_c$$

and $$e_b = p_b - p_c$$

where $p_a$ is the pressure at the larger end of the inlet diffuser $p_b$ is the pressure at the larger end of the outlet diffuser.

$p_c$ is the pressure at the inlet/outlet port.

Thus, in the forward flow state, one unit of flow enters the inlet diffuser and emerges from the outlet diffuser with no flow in the inlet/outlet port, the pressure drop $e_a$ is defined as one unit of pressure and the pressure drop $e_b$ is A of these units. In the reverse flow state, the same unit of flow is caused to flow into the inlet/outlet port and it emerges from the inlet diffuser with no flow in the outlet diffuser. The pressure drop $e_a$ is −B units of pressure and the pressure drop $e_b$ is −C units of pressure. In the reverse state $e_a$ and $e_b$ are negative so B and C are positive numbers.

In the table the numbers 1, −1, 0 define the important flow states. The parameters A, B and C are measurements of efficiency and it is the object of the device that A should be large, ideally it would be unity (representing 100%) typically it is 0.7. Both B and C should be as small as possible ideally both zero.

According to a further feature of the invention a method of pumping a liquid against a hydraulic head which comprises the steps of submerging in the liquid the combination of a convergent inlet and a divergent outlet arranged in general alignment and having between them a gap allowing permanently open communication with surrounding liquid so that the inlet and outlet are filled with the liquid, applying to the liquid in the inlet a pressure in excess of the hydraulic head thereby to force a forward flow of such liquid directly from the inlet to the outlet to constitute a delivery phase, relaxing the said pressure to less than the hydraulic head thereby to allow a measure of reverse flow which in proceeding from the outlet to the inlet entrains through the gap an ingress of the surrounding liquid to constitute a suction phase and repeating alternately the application and relaxation of pressure, so that the liquid ingress in the suction phases, together with any similarly entrained ingress in the delivery phases, represents a net pumped delivery. It will be understood that the invention also embraces pumping systems utilising the above defined method.

According to a still further feature of the invention a method of converting a reverse fluid flow into a unidirectional fluid flow, comprises the steps of connecting to one source of fluid supply a convergent inlet having an associated divergent outlet arranged in general alignment and having between them a gap connected to a port, connecting the divergent outlet to one branch of a flow junction, connecting a second convergent inlet to a second source of fluid supply, said second convergent inlet having a second divergent outlet arranged in general alignment and having between them a gap connected to a second port, connecting the second divergent outlet to a second branch of the flow junction, connecting a divergent outlet of the flow junction to a load, connecting said first and second ports to an outlet from the load, applying fluid under pressure to said first convergent inlet, which fluid is directed across the gap and along said first divergent outlet to said first branch of the flow junction from where it is directed along the divergent outlet from the flow junction, through the load, and to the port associated with the second convergent inlet and divergent outlet from where it passes out through the second convergent inlet, and then passing fluid under pressure through said second convergent inlet from where it is directed along said second divergent outlet to the second branch of the flow junction, from where it is directed through the divergent outlet from the flow junction through the load and to the port associated with the first convergent inlet and divergent outlet from where it is directed out through the first convergent inlet, successive alternate application of fluid to the first and to the second convergent inlets being passed unidirectionally through the load.

Several embodiments of the invention will now be described with reference to the accompanying drawings in which.

Figure 1:
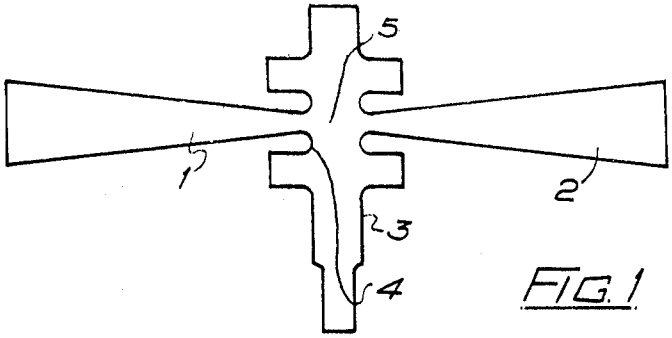
FIG. 1 is a schematic side elevation of a device according to the invention.
Figure 12:
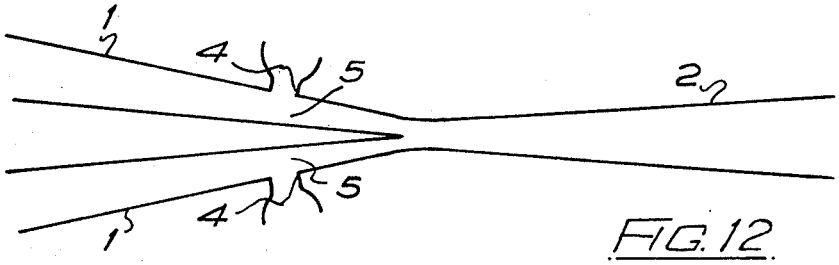
Figure 6:
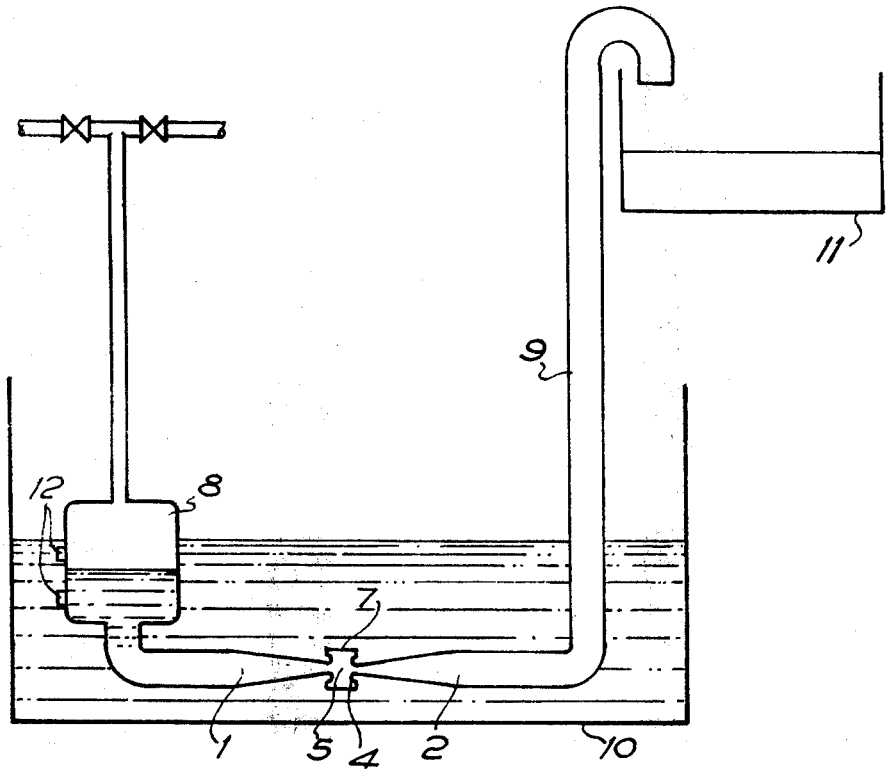
FIG. 6 is a schematic side elevation of a pumping arrangement utilising the device of FIG. 1.
Figure 7:
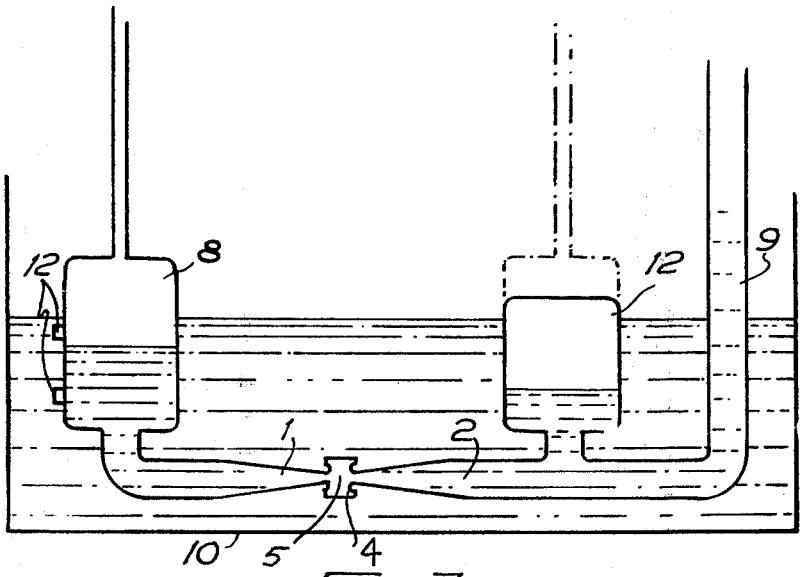
Figure 8:
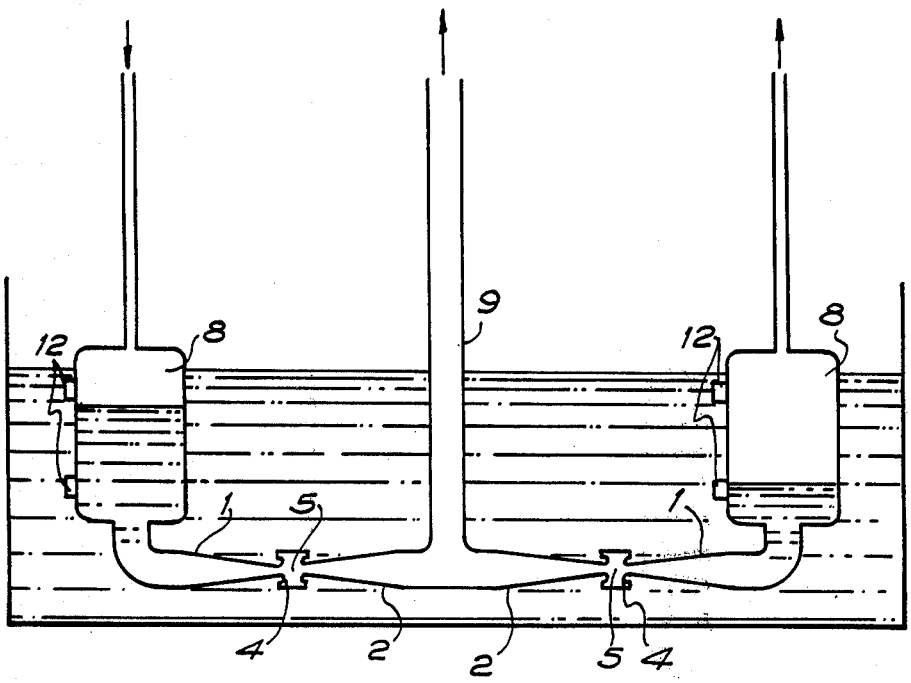
Figure 11:
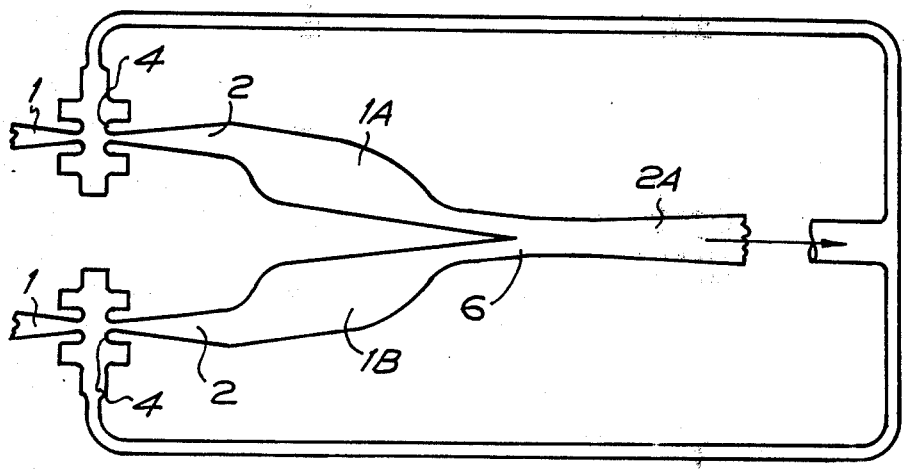
Figure 9:
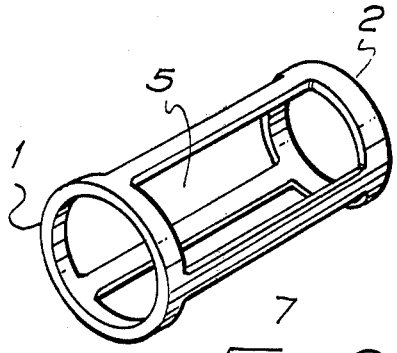
Figure 10:
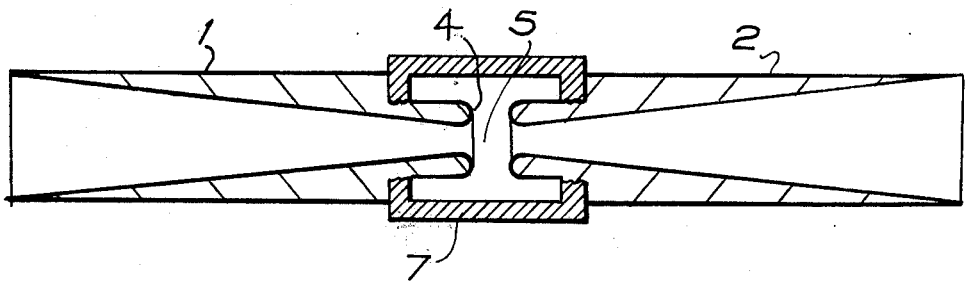

FIG. 7 corresponds to FIG. 6 but shows an alternative pumping arrangement utilising the device of FIG. 1;

FIG. 8 corresponds to FIG. 6 but shows a still further alternative pumping arrangement;

FIG. 9 is a perspective view of a cage to which the members of the fluidic flow control device of FIGS. 6, 7 and 8 are secured;

FIG. 10 is a sectional side elvation of a fluidic flow control device;

FIG. 11 is a typical control circuit employing two devices in accordance with FIG. 1 in conjunction with a flow junction; and, FIG. 12 is a schematic side elevation of two devices of FIG. 1 combined to form a single unit.

In its simplest form, as shown in FIG. 1, an RFD is formed by two conical diffuser sections 1, 2 in general co-axial relationship, although axial alignment is not critical so long as the internal profile of the device is smooth. Each conical diffuser is secured to a housing 3 to which is connected an inlet/outlet or feed port 4, the two diffuser sections being spaced to provide a gap 5. Generally, the cross-sectional areas are important to the correct functioning of the device and it is preferred that those areas have a distinct relationship. Thus, treating the minimum cross-sectional area of the diffuser 1 as one unit, the minimum cross-sectional area of the diffuser 2 should be between 0.8 and 4 and the minimum cross-sectional area of the inlet/outlet port 4 should be more than 0.8.

It is highly advantageous for the correct functioning of the device that the transition between the point on the diffusers of minimum cross-sectional area and the inlet/outlet port is a gradual transition of arcuate configuration.

Figure 2:
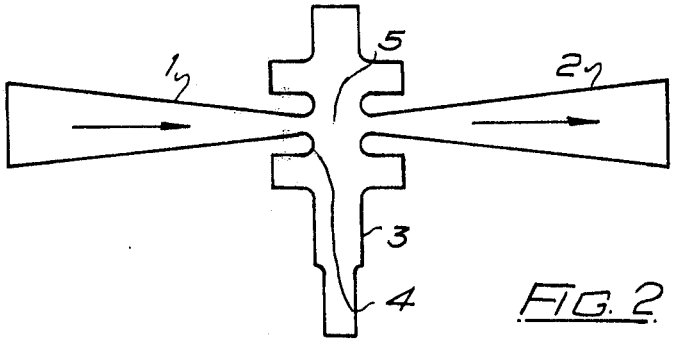
FIGS. 2 and 3 are schematic sectional side elevations of the device of FIG. 1 showing respectively the direction of fluid flow in the "forward" and "reverse" states.
Figure 3:
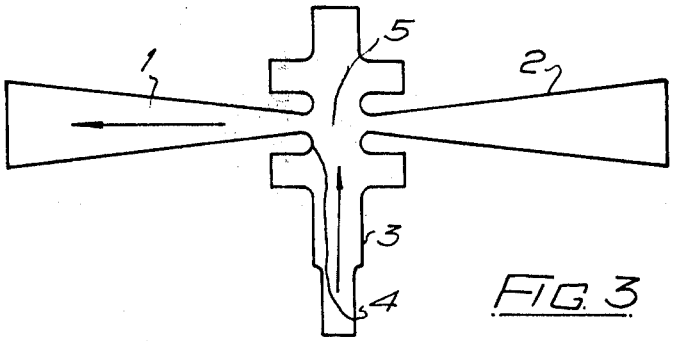

With the device of FIG. 1 included in a circuit for the transmission of fluid and in which it is necessary for the fluid to be reversed in direction, FIG. 2 represents the flow in what can be called the "forward" state and FIG. 3 shows the flow in what can be called the "reverse" state. Thus, in FIG. 2 fluid enters the inlet to the diffuser section 1 and as it progresses along that section its speed is increased and its pressure reduced. Fluid then passes across the gap 5 as a jet and enters the diffuser section 2 in which the speed is reduced and pressure recovered. In this "forward" state the pressure in the inlet/outlet port 4 is maintained low. In the "reverse" state (FIG. 3) fluid is admitted along the inlet port 4 to the gap 5 from where it passes into the diffuser section 1. In this condition it is important that the least possible resistance is imposed on the flow and that all the pressure drops are as small as possible in relation to those in the "forward" state.

It will be recognised that the precise cross-sectional shape of the RFD of FIG. 1 is not critical. It can be conical, as has been described, but equally it can be rectangular or any other convenient shape.

Figure 4:
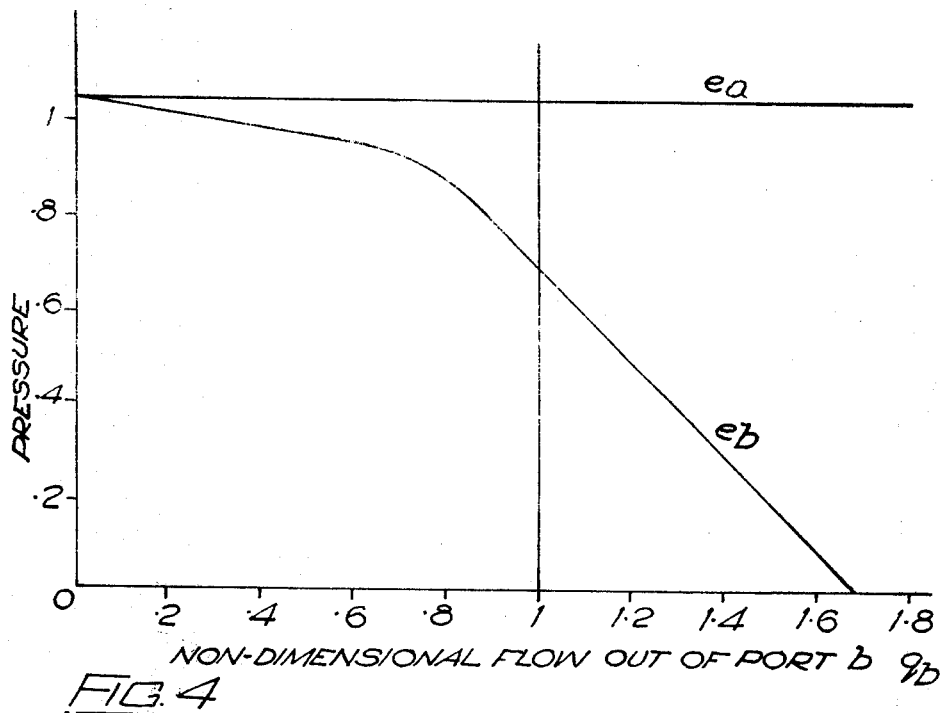
FIGS. 4 and 5 are respectively graphical representations of the forward range characteristics and reverse range characteristics.
Figure 5:
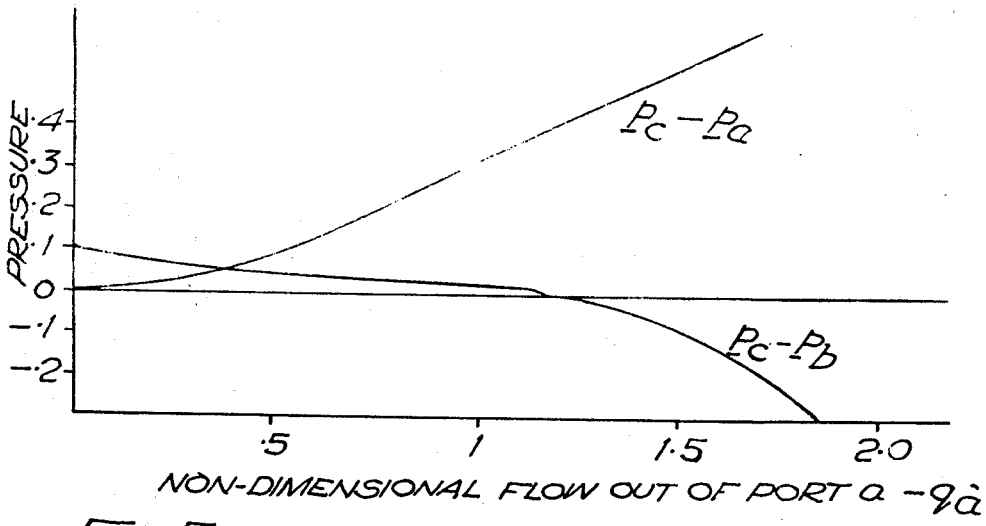

The RFD depicted in FIGS. 1 to 3 is ideally suited to operation in the two flow states defined as "forward" and "reverse". However, an RFD in accordance with the invention can also operate efficiently in a range of flow states, and different applications call for RFD's operating at various states within the range. In FIGS. 4 and 5 are shown the characteristics of what can be conveniently considered to be the "forward range" of flow states centered on the forward flow state and the "reverse range" centered on the reverse flow state respectively.

FIG. 4 assumes that the inflow at the inlet to the diffuser section 1 is held constant and the curves show the pressures $p_a - p_c$ ($e_a$) and $p_b - p_c$ ($e_b$) as a function of the outflow from the outlet diffuser 2. The pressures and flows are made non-dimensional by dividing by the value of $e_a$ in the forward state "$e_{af}$" (for pressures) and $q_a$ (for flows). The point at which $q_b = 1$ represents the forward state and the corresponding value of $e_b$ is the parameter A. When $q_b$ is greater than unity the extra outflow from the diffuser unit 2 is entrained through the port 4 in the manner of a jet pump and this action extends over the range of flow states from where $q_b = 1$ to the point at which the curve $e_b$ meets the axis $q_b$. This effective jet pump action is particularly strong when the diffuser units 1 and 2 of FIG. 1 are identical. Thus, RFD's of the invention are capable of serving the action of a jet pump to an extent dependent on the relevant size of the diffuser units. As the minimum cross-sectional area of the diffuser unit is increased in relation to that of the diffuser unit 1, the pumping range is increased but there is inevitably a reduction of the pressure $e_b$.

Considering FIG. 5, it is assumed that the inflow to the port 4 of FIG. 1 is held constant and of the same unit value as that utilised for $q_a$ in the forward state. The curves shown in FIG. 5 represent the variation of the pressures $p_c - p_a$ and $p_c - p_b$ as the flow out from the diffuser unit 1 is varied. Here again unit quantities are used and the pressures are made non-dimensional by dividing by $e_{af}$ (the value of $p_a - p_c$ in the forward state)

and for flow by dividing by $q_a$. The point at which $q_a = -1$ represents the reverse state, and the corresponding values of $p_c - p_a$ and $p_c - p_b$ are the values of parameters B and C respectively. Thus, a typical RFD meeting the characteristics of FIGS. 4 and 5 can be dimensioned as follows:

| | |
|---|---|
| Minimum diameter of diffuser-unit 1 | 9/32 ins. |
| Minimum diameter of diffuser-unit 2 | 11/32 ins. |
| Gap width | ¼ in. |
| $q_a$ | 120 litres/minute of air at ambient conditions |
| $e_{af}$ | 6.3 ins. water gauge |

The RFD of the invention as depicted in FIGS. 1 to 3 and the performance of which is shown in FIGS. 4 and 5 can readily be utilised in a variety of pumping systems and when the systems are ideally suited for the pumping of toxic, abrasive or other materials normally difficult to handle. Thus, as is shown in FIG. 6, a pumping system in accordance with the invention of this application comprises two diffuser sections 1, 2 separated by a gap 5. Conveniently the two diffuser sections are held together in spaced relationship by a cage 7. The inlet to the diffuser section 1 is connected to a cylinder 8 which cylinder is connected to a source of high pressure air. The outlet from the diffuser section 2 is connected by an out-feed pipe 9. Thus, as is shown with the diffuser sections 1 and 2 set in any suitable manner in the bottom of a tank 10, and with the out-feed pipe leading directly to a tank 11, fluid in the tank 10 can conveniently be pumped to the tank 11 as follows. Pressure is first released from the cylinder 8 and which allows fluid in the tank 10 to pass through the port 4 and the diffuser section 1 into the cylinder. The RFD in this condition is in the reverse flow state as is depicted by FIG. 3. On the application of pressure to the cylinder fluid is forced out of the cylinder 8 through the diffuser section 1 and the diffuser section 2 and when the RFD is in the forward flow state, as is depicted by FIG. 2. It will therefore readily be appreciated that by oscillating the pressure in the cylinder 8 the fluid in the tank 10 is intermittently pumped along the out-feed pipe 9 and into the tank 11.

During the reverse flow state a proportion of the liquid already in the out-feed pipe 9 flows back down into the RFD and through the diffuser sections 2 and 1. This would appear to detract from the speed of filling of the tank 11 but the reverse flow assists in the re-filling of the cylinder 8 and thus allows the re-filling to take place in a shorter time than would otherwise be the case and thereby facilitates an increased overall delivery. The flow state of the RFD in each phase under ideal conditions would be as has been described in relation to FIGS. 2 and 3. In practice the RFD may assume a jet pump action with the consequent entraining of fluid through port 4 during the forward flow state. Thus, for successful pumping, two conditions need to be satisfied i. in the forward flow state the gas pressure in the cylinder 8 must be greater than the hydraulic head existing between the tanks 10 and 11 ii. flow into the port 4 must occur in at least one phase of the operation

It is not, however, necessary for the air pressure in the cylinder during the reverse flow state to be lower than that at the inlet port 4. This is highly advantageous particularly in a high temperature use when hot, near boiling liquids are being pumped.

The intermittent pressurising and release of pressure from the cylinder to bring about the forward and reverse flow states can be brought about by any convenient means such that the level of liquid within the cylinder oscillates between two predetermined levels. This can be accomplished by providing one of a variety of conventions level sensing devices 12 at predetermined points on the cylinder. Thus, level sensing transducers, amplifiers or solenoid valves can be employed or, in the alternative, fluidic sensors provided. It is further possible to provide means for detecting the change in weight of liquid in the cylinders such as by providing torque measuring means at the base of the outfeed pipe. Yet again, with liquid drawn to the top of the cylinder the sudden change in impedance to the flow of liquid as it enters the air supply pipe can be detected by any suitable circuit and when the detection of the lower liquid level would be by the provision of a symmetrical dall tube or venturi at the outlet from the cylinder to detect the passage of the air/liquid interface.

The intermittent output of the pumping system of FIG. 6 can be smoothed and in certain circumstances made continuous by incorporating a gas volume or hydraulic accumulator-type unit as is shown in FIG. 7. Thus, between the outlet from the diffuser section 2 and the out-feed pipe 9 an accumulator 13 is provided and which is primed during the forward flow state in the RFD. During the reverse flow state liquid is supplied to the out-feed pipe 9 from the accumulator.

The accumulator may be closed when the inflow of fluid pressurizes the existing atmosphere and whereby fluid can be ejected from the accumulator by the pressurized atmosphere. Alternately, as is shown in broken line, the accumulator may be connected to a source of pressure gas.

However, under low head pumping conditions a very large accumulator could well be needed and in such circumstances it is preferable, as is shown by FIG. 8, to provide two cylinders 8 each connected to an inlet diffuser section 1 leading to a diffuser section 2 beyond an inlet port 4, the two diffuser sections 2 leading to the out-feed pipe 9. Thus, with the cylinders acting in alternation such that whilst one cylinder 8 causes the forward flow state in one RFD the other cylinder 8 causes the reverse flow state in the other RFD, each RFD provides intermittent supply of fluid to the out-feed pipe 9 and the two RFD's thus combine to provide substantially continuous flow of fluid through the outfeed pipe. As is shown particularly by FIGS. 9 and 10 the cage 7 is a simple construction comprising two end rings and connecting bars, the diffusers sections 1,2 being suitably connected to the rings e.g. by screw threads.

As is depicted in FIG. 11 RFD's as described in relation to FIG. 1 can be employed as such in a rectifier circuit causing a reversed (alternating) fluid flow to be converted into a unidirectional fluid flow by virtue of the inclusion of a flow junction which is constituted by two conical diffuser sections 1A, 1B which at their junction form a flow junction and which lead to a second conical diffuser section 2A. The circuit operates simply and efficiently. Thus, with a fluid admitted to the upper diffuser section 1 that RFD operates in accordance with FIG. 2 whereby fluid flows to the converging section 1A across the flow junction 6 and into the diffuser section 2A from where it travels to the inlet port 4 of the lower RFD which in this condition acts as depicted in FIG. 3. When the fluid flow is reversed, fluid is admitted to the diffuser section 1 of the lower RFD which then acts in accordance with FIG. 1 whereby fluid is transmitted to the converging section 1B and then to the diffuser section 2A. Therefore, irrespective of which of the two RFD's is acting in the "forward" state fluid is unidirectional in flow on reaching the diffuser section 2A.

Such a circuit can readily be used in, for example, a regenerative heating system for air such as to provide pre-heated air for use in, e.g., a blast furnace. Thus, the upper and lower RFD's of FIG. 9 would each be connected to one of a pair of regenerative heaters and the load (the furnace) would be somewhere beyond the outlet from the diffuser section 2A of the flow junction. Thus, in one condition air would be taken through an already heated regenerator through the rectifier circuit and into the load from where it would be taken back through the rectifier unit and on to the second regenerator to cause its pre-heating. Flow would then be reversed to pass further cold air through that second regenerator, through the rectifier unit and into the load from where it is taken back to the first regenerator via the rectifier. Thus, irrespective of which of the two regenerators is being utilised to pre-heat the air, the flow of air through the furnace is always in the same direction.

As an alternative to the circuit of FIG. 11, the two RFD's can be effectively merged together by providing two inlet diffusers 1 merging into a common diffuser section 2, with an effective gap 5 communicating with an inlet port 4 between each diffuser section 1 and the diffuser section 2 as is shown by FIG. 12. Thus, by connecting each diffuser section 1 to a source of fluid flow and by connecting the outlet diffuser section 2 to the load after the manner described in relation to FIG. 11, the combination RFD of FIG. 12 serves the purpose of both RFD's and the flow junction of FIG. 11.

It will be understood that other reverse flow systems can similarly employ the rectifier circuit of FIG. 11 such as in the pumping of difficult fluids.

What we claim is:

1. A fluid pumping system incorporating a fluidic flow control device having at least two generally aligned and axially spaced apart members having bores therethrough, said bores of said members being tapered, the members being so arranged as to constitute a gradual convergence followed by a gradual divergence, the adjacent ends of the members being substantially the same size and spaced apart to define a gap projecting radially and substantially perpendicular to the aligned bores and positioned between said adjacent ends of said members, the remainder of the system comprising a cylinder, a source of reciprocating pressure gas communicating with one end of the cylinder, the other end being connected to the inlet of one member, the outlet from the other member being connected to an out-feed pipe, said fluidic control device being set below the surface of a fluid to be pumped, the gap being open directly to the fluid surrounding said device, the reciprocating pressure applied to the cylinder causing said fluid to be first intermittently directly drawn into said flow control device and then into the cylinder and, secondly, additional fluid directly drawn into said fluid control device by the fluid from said cylinder flowing through said control device and the total fluid pumped through said out-feed pipe.

2. A pumping system as in claim 1, wherein the pressure applied to the cylinder is such as to oscillate fluid in the cylinder between two levels, there being provided level detection means associated with the cylinder to control the pressure gas being applied to the cylinder.

3. A pumping system as in claim 1, wherein between the out-feed pipe and the member to which the out-feed pipe is connected there is provided an accumulator whereby the intermittent nature of the pumping action is substantially reduced.

4. A pumping system as in claim 1, wherein two cylinders are provided each connected to a source of pressure, each cylinder being connected to one member of a fluidic flow control device, the other member of each device being connected to a common out-feed pipe, the intermittent pumping action of each cylinder and its associated fluidic flow control device being in alternation with the intermittent pumping action of the other cylinder and its associated fluidic flow control device whereby to provide substantially continuous flow of fluid through the out-feed pipe.

5. A pumping system as in claim 4, wherein the pressure applied to each cylinder is such as to oscillate the fluid in that cylinder between two levels, each cylinder being provided with level detection means to control the pressure gas being applied to the cylinder.

6. A method of pumping liquid against a hydraulic head which comprises the steps of submerging in the liquid the fluid control combination of a convergent inlet and a divergent outlet arranged in general alignment and having adjacent ends of substantially the same size, providing between the adjacent ends of the inlet and the outlet a gap projecting radially and substantially perpendicular to the aligned inlet and outlet allowing permanently direct open communication with surrounding liquid so that said inlet and outlet are filled with the liquid, directly applying to the liquid in the inlet a pressure gas in excess of the hydraulic head thereby to force a forward flow of such liquid directly from the inlet to the outlet and ingress of surrounding liquid through the gap while converging and then diverging the flow to constitute a delivery phase, relaxing the said pressure to less than the hydraulic head thereby to allow a measure of reverse flow which in proceeding from the oulet to the inlet entrains directly through the gap an ingress of the additional surrounding liquid to constitute a suction phase, the stream of fluid being generated through the gap being substantially the same size during both the delivery and suction phases and repeating alternately the application and relaxation of pressure, so that the liquid ingress in the suction phases, together with any similarly entrained ingress in the delivery phases, represents a net pumped delivery.

* * * * *